US008622153B2

(12) United States Patent
McLoughlin et al.

(10) Patent No.: US 8,622,153 B2
(45) Date of Patent: Jan. 7, 2014

(54) DOWNHOLE ASSEMBLY

(76) Inventors: Stephen John McLoughlin, Apse Heath (GB); George Swietlik, Lowestoft (GB)

( * ) Notice: Subject to any disclaimer, the term of this patent is extended or adjusted under 35 U.S.C. 154(b) by 307 days.

(21) Appl. No.: 12/733,480

(22) PCT Filed: Sep. 4, 2008

(86) PCT No.: PCT/GB2008/003014

§ 371 (c)(1),
(2), (4) Date: Mar. 3, 2010

(87) PCT Pub. No.: WO2009/030925

PCT Pub. Date: Mar. 12, 2009

(65) Prior Publication Data

US 2011/0120772 A1 May 26, 2011

Related U.S. Application Data

(60) Provisional application No. 60/967,307, filed on Sep. 4, 2007.

(51) Int. Cl.
*E21B 17/10* (2006.01)

(52) U.S. Cl.
CPC ..... *E21B 17/1014* (2013.01); *E21B 17/1078* (2013.01)
USPC ..... 175/325.5; 175/325.1; 175/325.3; 175/325.4; 166/241.1

(58) Field of Classification Search
USPC ..... 166/241.6, 241.1; 175/325.1, 325.3, 175/325.5, 325.4, 56
See application file for complete search history.

(56) References Cited

U.S. PATENT DOCUMENTS

| | | | | |
|---|---|---|---|---|
| 4,699,224 | A * | 10/1987 | Burton | 175/61 |
| 4,878,206 | A | 10/1989 | Grosso | |
| 5,117,926 | A | 6/1992 | Worrall et al. | |
| 5,226,332 | A | 7/1993 | Wassell | |
| 5,321,981 | A | 6/1994 | Macpherson | |
| 5,448,911 | A | 9/1995 | Mason | |
| 5,603,386 | A * | 2/1997 | Webster | 175/76 |
| 5,721,376 | A | 2/1998 | Pavone et al. | |
| 6,021,377 | A | 2/2000 | Dubinsky et al. | |
| 6,065,332 | A | 5/2000 | Dominick | |
| 6,158,470 | A | 12/2000 | Ivers et al. | |
| 6,166,654 | A | 12/2000 | Van Den Steen | |
| 6,327,539 | B1 | 12/2001 | Keultjes et al. | |
| 6,732,052 | B2 | 5/2004 | Macdonald et al. | |
| 6,847,304 | B1 | 1/2005 | McLoughlin | |
| 6,920,085 | B2 | 7/2005 | Finke et al. | |
| 6,945,338 | B1 | 9/2005 | Defourny et al. | |
| 6,948,572 | B2 | 9/2005 | Hay et al. | |
| 7,036,612 | B1 | 5/2006 | Raymond et al. | |
| 7,219,752 | B2 | 5/2007 | Wassell et al. | |
| 7,540,337 | B2 | 6/2009 | McLoughlin | |
| 2005/0121231 | A1 * | 6/2005 | Clayton | 175/55 |

OTHER PUBLICATIONS

PCT/GB2008/003014, Written Opinion of ISA.

(Continued)

*Primary Examiner* — Cathleen Hutchins
(74) *Attorney, Agent, or Firm* — C. W. Alworth

(57) ABSTRACT

A downhole assembly for insertion into a borehole comprising an articulated mandrel, a passive and an active damping mechanism operating on said mandrel for exercising control over torsional stick-slip and further proposing an improvement over the prior art which diminishes lateral shock.

24 Claims, 7 Drawing Sheets

(56) References Cited

OTHER PUBLICATIONS

SPE Publication, 16675-MS "Case Studies of BHA Vibration Failure" Mitchells and Allen, Sep. 1987.

API RP 7G, 12th Edition Sec.9.1 (May 1, 1987).

Warren and Oster "Improved ROP in Hard & Abrasive Formations" AMOCO Drilling Technology, DTP 1453 (Dec. 22, 1997).

SPE Paper 30475 "Flexible Bit: A New Antivibration PDC Bit Concept" Defourney and Abbassion.

* cited by examiner

DOWNHOLE ASSEMBLY

This disclosure claims benefit of priority from U.S. Provisional Application U.S. 60/967,307 filed in the U.S. Patent and Trademark Office on 4 Sep. 2007.

TECHNICAL FIELD OF THE INVENTION

The present invention relates to the field of rotary drilling tools.

BACKGROUND ART

In the field of rotary drilling the drillstring, obeying Hooke's Law is perceived, to act as a spring. The lower component of the drillstring, however, reacts differently to the drillpipe section of the drillstring as it has a very high torsional stiffness combined with a high modulus of elasticity. As a result of having these two major elements incorporated into the drillstring and adding bit and drill collar torsional resonance the drillstring undergoes harmonic oscillations which, at best, represent inefficiencies in the drilling process and at worst can cause drillstring failure with the added expense and unpredictability of remedial work.

Warren and Oster in "Improved ROP in Hard and Abrasive Formations" conclude that drill-collar torsional resonance in hard rock environments is responsible for PDC cutter damage and that reverse rotation of the drilling assembly is one of the more damaging elements of this particular drilling environment. The instant device seeks to identify such damaging conditions and improve the drilling process through active damping applied to the near-bit sub and distal components of the drilling assembly.

Perhaps the best single definition of stick-slip is given by John Dominick who provides a succinct description of the anomalies of drillstring behaviour in his [U.S. Pat. No. 6,065,332] "METHOD AND APPARATUS FOR SENSING AND DISPLAYING TORSIONAL VIBRATION."

"During drilling operations, a drillstring is subjected to axial, lateral and torsional loads stemming from a variety of sources. In the context of a rotating drill string, torsional loads are imparted to the drill string by the rotary table, which rotates the drill string, and by the interference between the drill string and the wellbore. Axial loads act on the drill string as a result of the successive impacts of the drill bit on the cutting face, and as a result of irregular vertical feed rate of the drill string by the driller. The result of this multitude of forces applied to the drill string is a plurality of vibrations introduced into the drill string. The particular mode of vibration will depend on the type of load applied. For example, variations in the torque applied to the drill string will result in a torsional vibration in the drill string.

At the surface, torsional vibration in the drill string appears as a regular, periodic cycling of the rotary table torque. The torsional oscillations usually occur at a frequency that is close to a fundamental torsional mode of the drill string, which depends primarily on drill pipe length and size and the mass of the bottom hole assembly (BHA). The amplitude of the torsional vibrations depends upon the nature of the frictional torque applied to the drill string downhole, as well as the properties of the rotary table. Torsional vibrations propagating in the drill string are significant in that they are ordinarily accompanied by acceleration and deceleration of the BHA and bit, as well as repeated twisting of the drill pipe section of the drill string."

The magnitude of these torsional and lateral characteristics represents a reduction in efficiency in the drilling process: thus, removal or reduction of these destructive elements would, naturally, constitute an improvement to drilling efficiency.

As can be inferred, "stick-slip" is a chaotic issue. In the environs of the bit and the bottom-hole-assembly some or all of the following characteristics may be present: drag, stick-slip—which at a maximum may cause the BHA to spin backwards, torque shocks (torsional vibration), BHA and bit whirl, drillpipe buckling, bit-bounce (axial shock loading of the BHA components) and lateral vibration. Warren et al comment that once whirl begins it is self-sustaining as the centrifugal force maintains the effect and that stopping rotation is the only effective way to stop whirl. Generally speaking, "stick-slip" represents an extreme of the condition referred to as "drilling vibration" or "harmonic vibration".

When, however, the bit is "off-bottom" it is evident that stick-slip decreases. Unfortunately having the bit off bottom also compromises the efficiency and economics of the drilling process. Thus, a primary mechanism in the creation of stick slip is bit to formation interaction. Confirmation of the bit as one of the root causes of stick-slip generation is found when drilling with a positive displacement motor (PDM). PDMs represent a form of Moineaux screw assembly, with internal rotor and external stator. Widely used for directional and performance drilling purposes PDMs reduce bit generated stick-slip as the rotor to stator interaction acts as a de-coupler between the torsionally rigid collars and the bit. Recently, high-torque output motors have removed some of this damping effect, until, in some cases, there is little visible difference in torque characteristics between drilling with a positive-displacement-motor and conventional rotary drilling.

Grosso, (SPE 16,660, September, 1987) concluded; "Downhole measurements of forces and accelerations within the BHA have shown that the vibrations at the bit have large quasi-random components for axial and rotational movements . . . probably due to unevenness of formation strength, random breakage or rock and amplification of these effects by mode coupling . . . " Grosso also concluded in (U.S. Pat. No. 4,878,206) METHOD AND APPARATUS FOR FILTERING NOISE FROM DATA SIGNALS, that stick-slip action was a combination of torsional and axial movements and that torsional and axial stick-slip measurement should be considered separately.

However, for the purposes of remedial action it is insufficient merely to measure quantities of shock and vibration. Other drillstring attributes need to be considered in order to be meaningful.

Prior art in the domain of vibration measurement and control is plentiful, yet, to date, there has been little success in creating a panacea for stick-slip or success in diminishing drillstring harmonics and thereby deriving improvements to the drilling process.

The major identified sources of harmonic vibration are the rotary drive system above the rotary table, the drillstring, the torsionally rigid element of the BHA component of the drillstring and the bit to formation interaction. Each has a varying degree of influence in the total system vibration and adding further complexity, each has an interactive effect on the other. Thus variations in bit generated torque will reflect in drillstring torque which feeds back into the rotary drive system: the system is complex, iterative and constantly changing.

Prior art in this domain largely reflects two separate schools of thought; harmonic reduction through surface control means or by downhole control means. However, historically, neither the selection of a surface nor a downhole approach to harmonic damping, has achieved success across a wide range of geological formations. In certain environments and circumstances, however, both approaches have achieved limited success.

The first approach asserts that stick-slip can be diminished through more precise control over the surface drive mechanism. As this represents the variable means of torque input into the drilling system, the premise of this group of industry studies and intellectual property is that by oscillating the drillstring at surface proportionally to the observed harmonic frequency of the drilling assembly and in particular the drillstring, that drillstring downhole torque can be controlled and harmonic vibrations and in particular stick-slip reduced to within acceptable limits. Practical applications of this theory have proved effective in some situations.

Worrall, (U.S. Pat. No. 5,117,926) METHOD AND SYSTEM FOR CONTROLLING VIBRATIONS IN BOREHOLE EQUIPMENT provided for control of the energy flow through the borehole equipment by defining "across" and "through" variables "wherein fluctuations in one variable are measured and the energy flow is controlled by adjusting the other variable in response to the measured fluctuations in said one variable."

Van Den Steen (U.S. Pat. No. 6,166,654) DRILLING ASSEMBLY WITH REDUCED STICK-SLIP TENDENCY acknowledging the influence of topdrive and above rotary table harmonics proposes the addition of surface mounted torsional viscous damper sub-systems to the drilling assembly with the aim of introducing a lower rotational resonant frequency into the drilling assembly by negating harmonic influences induced by the rotating equipment located above the rotary table.

Keultjes et al (U.S. Pat. No. 6,327,539) METHOD OF DETERMINING DRILL STRING STIFFNESS proposes the determination of the rotational stiffness of a drill string and in particular determining the moment of inertia of the BHA for optimizing energy within the drilling assembly so as to reduce stick-slip effects.

The second school of thought asserts that downhole measurements and associated downhole mechanisms are the preferred route to controlling stick-slip in the bottom-hole assembly.

Prior art in the domain of passive damping devices for rotary drilling has been deployed for over half a century. Generically they are referred to as "shock-subs". Typically these devices have a splined, telescopic shaft axially co-located within a hollow cylindrical housing. When subjected to axial shock these devices perform a controlled telescopic translation along the principle axis of the borehole until the entirety of the shock has been absorbed. Internal damping mechanisms vary, but are predominantly Belleville spring, fluid compression, ring spring or gas charged. These devices have some degree of effectiveness, but are constrained by having their own internal natural frequency, which, at some stage will compound the existing wellbore harmonic. Additionally, shock subs are, largely, incompatible with directional drilling processes, directional wells and also relatively ineffective when dealing with high magnitude harmonic vibrations.

These devices also have inherent natural frequencies of their own which are not field tunable to provide damping capability Across wider ranges of harmonic vibration. In summary, they individually provide a single solution which attempts to suit the entire range of harmonic vibration conditions. The instant device constitutes an improvement over prior art in that although it has an inherent primary damping natural frequency, it preferentially also provides for selective damping across a plurality of alternative or secondary frequencies which exist in the distal environment.

Early prior art focused on the measurement of vibrations in the bottom-hole assembly, with the objective of quantifying accelerational characteristics although downhole sampling and processor speeds prevented analysis across the wider range of harmonics.

As an alternative to damping bit generated vibration across the entire frequency spectrum, prior art corrective procedures have generally either focused on the practical measures of predicting and avoiding critical rotary speeds, although chaotic rotary vibration rendered this approach problematic: SPE Publication, 16675-MS "CASE STUDIES OF BHA VIBRATION FAILURE" by R. F. Mitchell and M. B. Allen, September, 1987 included the following commentary:

"Speeds that might result in destructive lateral vibrations are addressed with equations 9.11 and 9.12 of API RP 7G. A recent study has shown that these equations, even when modified to account for fluid added mass and precessional forces, do not accurately predict critical rotating speeds and do not correspond well with field experience."

By 1990 the aforementioned formulae had been removed from API RP7G, which publication added as a comment:

"Numerous field cases have indicated that previous formulations given in Section 9.1 of API RP 7G, $12^{th}$ Edition (May 1, 1987) did not accurately predict critical rotary speeds and thus have been removed. Presently no generally accepted method exists to accurately predict critical rotary speeds."

Once accurate measurements were made of acceleration and vibration which could be reconstructed to quantify downhole harmonic vibration these were conveyed back to the surface of the earth using any of a variety of commercially available telemetry methods or recorded in the downhole environment and reserved for post-well analysis. At surface "BHA Modeling" took place. BHA modeling, largely using finite-element analysis techniques sought to avoid specific resonant vibrations which were incompatible with a specific configuration of BHA, drill bit and rock formation configuration. However, even slight hole enlargement reduces pre-well BHA Modeling effectiveness as it alters the natural frequency of the BHA. The degree of hole enlargement is, additionally, unquantifiable until the well is in progress.

Research has shown that the main causes of premature bit and BHA damage in any one drilling scenario are, largely, confined to one or two major frequencies with single "sidebands". The abstract of MacPherson (U.S. Pat. No. 5,321,981) "METHODS FOR ANALYSIS OF DRILLSTRING VIBRATION USING TORSIONALLY INDUCED FREQUENCY MODULATION" informs:

"Torsional oscillations of the drillstring will lead to frequency modulation (FM) of the signal from a vibratory source (e.g. the bit). This results, in the frequency domain, in sidebands being present around a detected excitation frequency. In accordance with the present invention, it has been discovered that these sidebands may be used in advantageous methods for optimizing drillstring and drilling performance. In a first embodiment of this invention, these sidebands are used to discriminate between downhole and surface vibrational sources."

Mason, (U.S. Pat. No. 5,448,911) METHOD AND APPARATUS FOR DETECTING IMPENDING STICKING OF A DRILLSTRING utilized a comparative method which identified impeding downhole sticking conditions and compared them to observed surface conditions. The objective being to identify surface condition parameters which were to be avoided.

Wassell (U.S. Pat. No. 5,226,332) VIBRATION MONITORING SYSTEM FOR DRILLSTRING proposed an alternate configuration for downhole sensors which allowed for enhanced accuracy in measurement of lateral and torsional vibration.

Pavone (U.S. Pat. No. 5,721,376) METHOD AND SYSTEM FOR PREDICTING THE APPEARANCE OF A DYSFUNCTION DURING DRILLING focused on the creation of a drilling model constructed from measurements taken from sensors located in the drillstring.

Later art in the field of vibration damping through application of downhole assemblies and mechanisms has focused on intelligent networks and processes which utilize the integration of multiple sensor inputs with logic control either encompassed within a downhole device or, alternatively transferred back to surface in order for the operator to make corrective actions.

The importance of completeness of data is revealed by, among others, Warren and Oster "Improved ROP in Hard and Abrasive Formations" who, in a detailed discussion on bit wear, make the following observations:

"Whether or not a cutter moves backwards depends on the amplitude of the accelerations, the frequency of the accelerations and the average rotary speed. FIG. 47 shows the amplitude/frequency regions for 60 rpm and 120 rpm where backwards rotation can occur. In general for a typical frequency of 20 Hz, any accelerations over 3.5 G for 60 rpm and 6.5 G for 120 rpm result in reverse rotation. These conditions are often observed on the D(rilling) D(ynamics) S(ub) data.

The implication of this is that without, at a minimum, the amplitude, frequency and average rotary speed of a drilling assembly, active, adaptive, vibration damping cannot take place. Unfortunately, not all of these inputs can be measured in the downhole environment.

Dubinsky et al (U.S. Pat. No. 6,021,377) DRILLING SYSTEM UTILIZING DOWNHOLE DYSFUNCTIONS FOR DETERMINING CORRECTIVE ACTIONS AND SIMULATING DRILLING CONDITIONS, provides for a "closed-loop" system where downhole dysfunctions are quantified by sensors and the results telemetered to surface where a surface control unit determines the severity of dysfunction and the operator provides corrective action which is required to alleviate the dysfunction at surface.

MacDonald et al (U.S. Pat. No. 6,732,052) METHOD AND APPARATUS FOR PREDICTION CONTROL IN DRILLING DYNAMICS USING NEURAL NETWORKS proposes:

"A drilling system that utilizes a neural network for predictive control of drilling operations. A downhole processor controls the operation of devices in a bottom hole assembly to effect changes to drilling parameters [and drilling direction] to autonomously optimize the drilling effectiveness. The neural network iteratively updates a prediction model of the drilling operations and provides recommendations for drilling corrections to a drilling operator."

This approach has achieved some recent success; however, its objective is the avoidance of BHA/well specific destructive RPM ranges through operator intervention at surface. Using these methods may reduce harmonic vibration, yet compromise rate of penetration as a result of the selection of sub-optimal drilling RPM ranges. Once destructive harmonics have been identified, they are avoided, rather than corrected for and negated.

Prior art in the field of downhole mechanical bit vibration damping revealed in DEFOURNY et al (U.S. Pat. No. 6,945,338) DRILLING BIT ASSEMBLY AND APPARATUS proposes a fixed cutter bit with isolative damping capability particularly between bit cutters and bit body. Several formats are introduced within the scope of the Defourny patent, all of which have the intention of isolating the bit from the destructive properties associated with drill collar whirl and BHA induced vibration.

Defourny and Abbassian explain the practical advantages of their system further in SPE Paper 30475 "Flexible Bit: A New Anti-Vibration PDC Bit Concept":

"Due to the rigid connection between the bit and the BHA, vibration events originated in the BHA can influence the dynamic motion of the bit and vice versa. As a consequence of this dynamic coupling, a given vibration mechanism, which involves the bit, can trigger one involving the BHA. For example, extreme bit slip-stick torsional vibrations have been observed to cause BHA lateral instability which can in turn trigger whirl as a result of increased BHA/Wellbore interaction. Conversely, BHA whirl can induce lateral bit instability"

The instant invention initially proposes improvement over Defourny in that it is stabilized within the borehole. The stabilizer element advantageously confines the radial motion of the tool within the borehole, providing limitations to the internal attitudinal motion and constraint to lateral and torsional degrees of freedom conferred thereby. Additionally, the stabilization means conveys potentially destructive energy from the drilling assembly to the borehole wall. Furthermore, prior art relies upon the "resiliently deformable spacer" for the effective transfer of torque from the first member of the drilling assembly to the second member of the drilling assembly [Claim 1], whereas the invention disclosed herein provides for direct, compliant, metal-to-metal torque transfer between first and second member yet without loss of intra-device articulation. Additionally, prior art was constrained to a single natural frequency, whereas the instant device offers improvement over prior art in that it is adaptive, adjustable in the downhole environment, and provides damping across a wider range of drilling conditions without the requirement to reconfigure or trip the device to surface.

Given the frequency of harmonic vibrations associated with the drilling process and the requirement for timely corrective action, hydraulic system response times may prove to be inadequate for active damping control mechanism purposes. This is particularly evident where the bit generated vibration frequency is relatively high in both frequency and amplitude and a proportionately rapid damping response is required. A more timely damping response time may be obtained by electro-mechanical or, preferentially, electro-hydraulic control means which are proposed as an integral inventive step of the instant device.

More recent prior art by Raymond et al (U.S. Pat. No. 7,036,612) CONTROLLABLE MAGNETO RHEOLOGICAL FLUID BASED DAMPERS FOR DRILLING sought to overcome the limitations inherent in a purely hydraulic damping mechanism by proposing a controllable damping apparatus for the downhole reduction of harmonic vibration. This device, which utilizes a traditional shock absorber format, incorporates restrictive valves which have magneto rheological fluid ("MR Fluids") housed within a chamber with an orifice between two sections of the chamber. An electromagnetic coil "employed proximate the orifice" controls the flow of fluid between the two sections.

M R Fluids ("MRF") are fluids which have an initial state and a second state and whose material properties are altered through the presence of a magnetic field. The first lower viscosity state is the natural state of the fluid, whereas the second, high-viscosity state is induced through the application of magnetic field to the fluid. The magnetic field may be induced by application of real-earth magnets, or, alternatively through the application of electro magnetic field. The magnetic field may also be permanent or temporary in nature without detriment to the characteristics of the fluid. Additionally, it may also be configured to be a bi-state, binary operator, temporary or pulsed, thus making it almost infinitely adjustable across a range of values.

Magneto Rheological materials encompass materials with both fluid and solid properties. Although MRE ("Magneto Rheological Elastomers") are, from certain material property standpoints, preferable to the fluid properties which are encountered with magneto rheological fluids, energy consumption demands which are inherent in MRE deployment make it preferable to utilize MRF. From a comparative perspective, it appears from manufacturers' specifications, that energizing an MRE takes approximately 2.5 times the power draw of energizing an MR Fluid. Thus, the instant device may incorporate by reference MRE, but preferentially use MRF as an active element in its adaptive actuation mechanism.

Advantageously, the "activation-time" between states is relatively rapid. The Lord Corporation, manufacturers of fluids with MR properties quote activation times of 0.07 seconds. This corresponds to a frequency of 14.25 Hz, placing it within the upper range of vibrations encountered in harsh drilling conditions.

The Raymond mechanism claims means for "providing frictional properties that are alterable while the drillstring is in use; and controlling the frictional properties based upon changing ambient conditions encountered by the bit. The invention preferably dampens longitudinal vibrations and preferably additionally dampens rotational vibrations. Two damping mechanisms in series may be employed."

The axial and torsional vibration damping mechanisms in the Raymond invention are physically separate in the Raymond invention, leading to a device which is substantially longer and more flexible than the one proposed in the instant invention. Thus the instant invention incorporating both axial and torsional damping means within a single, truncated element presents improvements over prior art in that it is shorter, approximately one-quarter the length] less flexible and thus has a more predictable modulus of elasticity which is operationally advantageous. The instant invention advantageously claims the benefit of lateral vibration damping control, which ability is outside the scope of the Raymond device.

The Raymond device was configured with mechanical spring mechanisms as its basis. Various configurations having natural frequencies which were reported as 32.39 Hz, 26.45 Hz and 12.83 Hz respectively were used. Despite the use of mechanical damping means with various natural frequencies in combination with MR damping mechanisms, the experiments which were carried out and reported in Raymond showed that some spring configurations were less beneficial than others. Thus, the performance of MR damping means in Raymond was contingent on the natural frequency of the mechanical spring mechanisms.

"The importance of choosing the correct spring stiffness for the shock sub is shown in FIG. 12 for a 1500 lb WOB and 180 RPM in SWG ("Sierra White Granite"). This figure compares the effect of using 32.39, 26.45 and 12.83 Hz shock subs, with comparable damping levels to a rigid system. The 12.83 Hz shock sub performs best.

Background materials in Raymond suggest that while the 12.83 Hz shock sub may perform best with the bit size and cutter configuration selected in the undertaking the field experiments, that this particular frequency is not, of itself, a panacea. Nor is it evident that a sprung system with a lower natural frequency is ultimately more successful across a range of drilling conditions than one with a higher natural frequency.

The construction of the instant invention is such that it has no internal spring mechanism and additionally, that there is no causal relationship between the closed cell elastomeric material which acts as the primary damping mechanism and the secondary, active damping mechanism. This advantageous construction, having no constraining natural frequency, means that the active MR damping means is functionally independent. This, therefore, constitutes a significant improvement over prior art. Additionally, as will be shown, magneto-rheological damping means will be employed which will enable adaptive damping to suit changing drilling conditions. Further, the MR damping capability will be capable of being continuously, discontinuously, intermittently or sporadically activated on command and in conjunction with pre-determined sensor and logic means in order to arrive at damping whose effectiveness is energy efficient.

The Raymond device incorporates a mud powered turbine generator with which to generate electrical power for the downhole device. The turbine generator adds significant additional length to the device and, were the Raymond device to be deployed in the near bit position, would place additional distance between the bit surveying devices located proximate the bit.

An improvement over the Raymond device is disclosed in U.S. Pat. No. 7,219,752 to Wassell et al SYSTEM AND METHOD FOR DAMPING VIBRATION IN A DRILLSTRING in which the valve mechanisms incorporated within the damping device receive particular attention. As with Raymond, the Wassell device also has its basis in traditional shock absorber mechanism construction with a stroke length which is several inches in length. The Wassell device features an axial damping spring assembly and torsional bearing assembly which are individually configured and separated by a valve assembly with the objective of diminishing bit and drillstring generated vibration.

The instant device claims advantage over both Raymond and Wassell in that it is constructed specifically to diminish bit generated vibration, has no stroke length, providing for a shorter more rigid construction for incorporation into the BHA which is not influenced by internally generated displacement related harmonics.

Additionally, the instant device features a combined and integrated axial and torsional and lateral damping element which favourably provides for insertion of the invention in the near-bit stabilizer position This mechanical construction, in combination with active and secondary damping elements which are unique to the instant device acknowledges that the amplitude of bit generated harmonic vibration typically requires a damping mechanism with a relatively short stroke.

A further improvement over Wassell, which will be explained later, is the ability to provide adaptive damping response by informing the instant device of alterations to relevant surface and downhole parameters through use of a downlink protocol.

In a further improvement over prior art, the a device in accordance with an embodiment of the present invention proposes the use of simplified, commercially available magneto-rheological control mechanisms such as those described in Ivers et al (U.S. Pat. No. 6,158,470) TWO WAY MAGNETORHEOLOGICAL FLUID VALVE ASSEMBLY AND DEVICES USING SAME. These valve configurations enable simplified hydraulic circuitry and control means to be deployed in conjunction with electro-magnetic coil elements and MR fluid which may advantageously be utilized within the instant invention.

The instant device, which will be described later, may effectively also utilize piezo-electric fibre technology as a means for measuring vibration. Additionally, the instant device may use piezo-electric fibre technology for the purposes of generating power as an integral component of the mechanism.

Therefore, as the generated electrical power is proportional to the amount of vibration encountered in the downhole environment, piezo electric fibre ["PE Fibre"] technology may advantageously be used both as a measurement and a control and activation means. The utility of the PE Fibre technology can be put is dependent on its generation, which is, in turn, dependent on the amount of vibration encountered in the distal elements of the BHA.

The inventors believe that the partial successes of prior art and the body of information accumulated to date indicate that it is insufficient to obtain sensor data from a single source of harmonics and that an integrated closed loop, adaptive approach is required. Notwithstanding sensor measurements made within the instant device, without information pertaining to wider environmental conditions and at a minimum surface RPM, the downhole device has insufficient information to be able to determine the appropriate frequency of corrective actions. This will provide for versatility and adaptability to changing drilling conditions. Additionally it allows for real time adjustments to be made to the downhole device without compromising the efficiency and effectiveness of the drilling process. Thus, the instant device claims improvement over prior art through the incorporation of both surface and downhole data in its approach to the control of harmonic vibration within the single, instant, device. In addition to surface parameters, the downlinked data may incorporate, data derived from measurement-while-drilling "MWD" telemetry and which may further communicate component measurements pertaining to the real-time downhole vibrational state from sensors located in other components of the BHA to the instant device, via the surface of the earth. The information which is transmitted may be raw, processed or encoded sensor data. At the surface the uplinked information is additionally utilized in order to preferentially modify surface RPM, thus optimizing the environment for operation of the downlink protocol.

In order to achieve this, a downlink communications protocol is required. Downlinking refers to the ability to send data from the surface of the earth to a downhole device. Used in conjunction with industry standard "uplink" protocols, the combination of systems is frequently referred to within the industry as "closed-loop".

Although "closed-loop" is referred to in several prior art publications, and most recently in particular with regard to providing instructions for 3-dimensional rotary steerable systems ("3D-RSS") its utility as a element with which to reduce harmonic vibration has, largely, gone un-remarked.

Hay et al (U.S. Pat. No. 6,948,572), COMMAND METHOD FOR A ROTARY STEERABLE DEVICE, restricts the application of its downlink protocol to usage with a 3D-RSS:

Claim 1: In a drilling system of the type comprising a rotatable drilling string, a drilling string communication system and a drilling direction control device connected with the drilling string, a method for issuing one or more commands to the drilling direction control device . . . "

Alternatively, Finke et al (U.S. Pat. No. 6,920,085), "DOWNLINK TELEMETRY SYSTEM" using timed fluctuations in the drilling fluid pressure, provides for instruction via pressure pulses to a downhole assembly. In this case the designated receiving tool is a "Pressure While Drilling" tool.

McLoughlin (U.S. Pat. No. 6,847,304) "APPARATUS AND METHOD FOR TRANSMITTING INFORMATION TO AND COMMUNICATING WITH A DOWNHOLE DEVICE" proposed a discontinuous method for communicating between surface and a 3D-RSS device configured about a non-rotating stabilizer format and utilizing variations in the rotary speed of the drilling assembly. Principally, this method allowed for periods of reduced or null rotary speed as components in the communications protocol.

It may be noted that all downlink prior art protocols, unless using customized, hard-wired drillpipe, for example, such as those proposed in Hall (U.S. Pat. No. 6,670,880) "DOWNHOLE DATA TRANSMISSION SYSTEM and Hall (U.S. Pat. No. 6,392,317) "ANNULAR WIRE HARNESS FOR USE IN DRILL PIPE, in some way compromise the integrity of drilling operations.

A device in accordance with an embodiment of the present invention claims improvement over prior art through the incorporation of a methodology for communicating information from the surface of the earth to a downhole device on a semi-continuous or continuous basis without utilizing customized drill-pipe, or compromising the drilling operation, which method constitutes an improvement over claims made by prior art.

A downlink communications protocol method, systems and apparatus which may fulfill the desired criteria without compromising drilling operations is disclosed as U.S. Pat. No. 7,540,337 to McLoughlin & Variava, ADAPTIVE APPARATUS, SYSTEM, AND METHOD FOR COMMUNICATING WITH A DOWNHOLE DEVICE which proposes a downlink protocol which uses the optimized surface drilling RPM as a baseline for a real-time adjustable communications protocol. Advantageously, the system is capable of adaptive recalibration to accommodate alterations to the baseline RPM, without compromising drilling performance. At surface minor alterations to the frequency of the baseline drilling RPM are made in accordance with pre-determined timing intervals with the objective of conveying information to a device or multiple devices located at the distal end of the drilling assembly. As previously commented, the downhole device is instrumented such that rotational velocity can be determined by any of a number of well understood means, in order to be able to identify alterations to rotational speed in the distal environment.

Thus a significant improvement which an embodiment of the present invention claims over prior art is the closing of the communications loop between the surface of the earth and the instant downhole device, supplying data for the purposes of enabling adaptive damping means and without detriment to the drilling process.

SUMMARY OF THE INVENTION

In a first aspect, the present invention provides an adaptive system, method and apparatus for active vibration damping and control of downhole systems.

In an embodiment, the invention comprises a system and apparatus and method of controlling and adjusting the attitude of drill-collars with respect to the drill-bit in the rotary drilling process, the advantage of which, via means of a ball-joint torque transfer mechanism, allows for relative lateral motion therebetween. Advantageously, the attitude control mechanism provides for reduced lateral vibration which substantially diminishes bit radial force and mass imbalances, resulting in an improvement to the rate-of-penetration. The attitude adjustment is intrinsic to the device, system and apparatus.

According to an embodiment, the invention exercises control over torsional stick-slip and additionally proposes improvement over prior art in the construction of a mechanism which diminishes lateral shock.

Preferentially, the system, method and apparatus for substantially reducing or eliminating bit and drill collar induced drilling vibration comprises a near-bit device which is equipped with stabilization which centres it within the borehole. The device additionally constitutes an improvement over prior art in that it claims the benefit of having a natural frequency which is alterable in the downhole location which advantageously provides for compliance across the entire range of drilling vibrations.

The device, although functionally autonomous, may preferentially work in collaboration with a surface downlink protocol which is responsible for transferring information pertaining to drilling parameters and conditions from the surface of the earth. Such a protocol is described in U.S. Pat. No. 7,540,377 to McLoughlin & Variava, ADAPTIVE APPARATUS, SYSTEM AND METHOD FOR COMMUNICATING WITH A DOWNHOLE DEVICE. The surface downlinked information is communicated to electronics, logic and control systems within the downhole assembly, thus closing the loop between surface and downhole and allowing the downhole assembly to be functionality adaptive to real-time drilling conditions. Advantageously, the device profits from the vibration inherent in the distal component of the downhole environment in order to harvest electrical energy through the integration of materials which have piezo-electric properties. Primary damping capability within the instant invention is derived from closed cell elastomeric material. The device also confers hydraulic damping capability across a range of frequencies and is equipped with appropriate hydraulic circuitry. Preferentially, the hydraulic circuitry of the device may be configured advantageously to utilize the variable rheological properties inherent in magneto-rheological fluids to achieve a damping across a wider range of frequencies or in controlling the tool's operation.

The instant device and downlink protocol may also preferentially work in conjunction with a TORSION SUB, which is advisably located in the drilling assembly proximately in relation to the surface of the earth. The objective of the Torsion Sub is to provide damping to the BHA, inhibiting drill-string induced axial and torsional vibrations. The Torsion Sub is the subject of a Co-pending U.S. Provisional Patent Application Ser. No. 60/967,306 entitled "ADAPTIVE, COMBINED AXIAL AND TORSIONAL COMPENSATION SYSTEM, METHOD AND APPARATUS for ACTIVE VIBRATION DAMPING," filed on Sep. 4, 2007 and published as WO 2009/030926 A2/A3 under the title "A Downhole Device."

In a further aspect, the present invention provides control over downhole system and apparatus by which control is exercised over an articulated mandrel by hydraulic fluid transfer means and preferentially whereby axial, torsional and lateral shock damping means is enabled; wherein, the fluid is preferably transferred between piston means of equal volumes.

The above method an apparatus is preferably equipped with stabilizer means for the purposes of centering the device within the borehole and for providing energy dissipation thereby and wherein an articulatable torque transfer mechanism may provide for degrees of freedom between structural elements of the device in which a resilient fluid passageway may be provided which provides intra-structural support, additionally serving to isolate the torque transfer mechanism and active vibration element means from drilling fluids.

The damping means may be passive. The damping means may be active and adjustable within the apparatus. The active damping means may utilize variations in rheological fluids. The damping capability may be modifiable in frequency and amplitude, responsive to harmonic vibration encountered in the environs of the drill bit. The damping means may preferentially incorporate electro-mechanical or electro-hydraulic valve means. Hydraulic actuation capability may be proportional, continuous, discontinuous, intermittent or sporadic, responsive to harmonic vibration encountered in the environs of the drill bit. The apparatus may be informed of events pertaining to alternate physical locations within the drilling assembly.

Piezo-electric (fibre) structures may be utilized for measurement, as a means of quantifying forces to be applied or as actuation motive means within the device.

In a further aspect, the present invention provides a downhole system, method and apparatus with adaptive, active, multi-frequency damping which is functionally adjustable in the downhole location in response to changing drilling harmonics, and which may also be a control mechanism for downhole systems.

BRIEF DESCRIPTION OF THE DRAWINGS

The present invention will now be described with reference to the following preferred, non-limiting embodiments, in which.

MODES FOR CARRYING OUT THE INVENTION

Including a Functional Explanation

The device will first be discussed in general terms in order to explain embodiments of the invention. It will be described in several forms, all of which have similar objectives and which have varying degrees of technical complexity. Principally, this device differs from prior art in the field of downhole vibration damping in that it provides damping for rotational, longitudinal and lateral vibrations, it is responsive to information conveyed to it in real time from the surface of the Earth, that it is constructed with an inherently variable natural frequency and that, advantageously, it seeks to harvest energy from the downhole environment.

Figure 1:
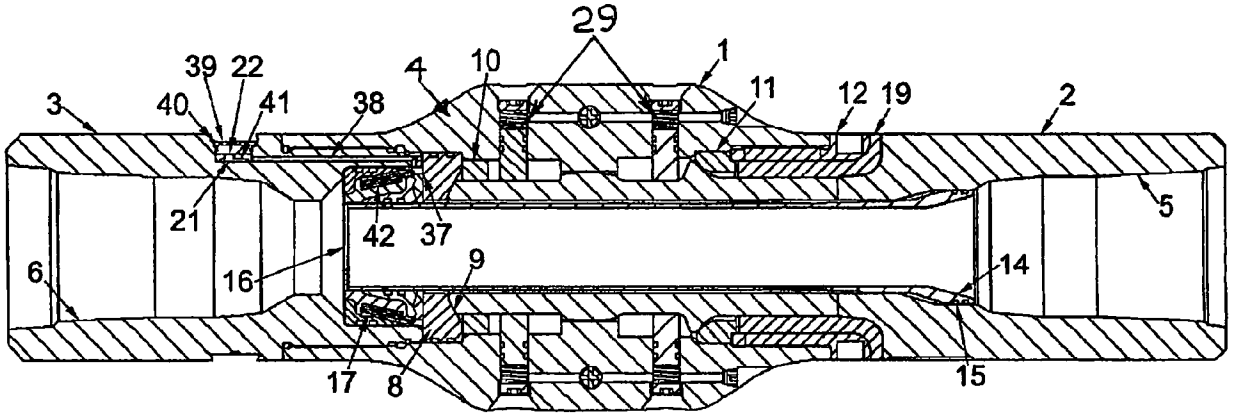
FIG. 1: is a longitudinal cross-sectional view of the instant invention.

Referring to FIG. 1: The instant stabilized mechanism comprises a stabilizer sleeve element [1] which is radially co-located about a bi-partite internal mandrel sub-assembly [2], [3]. The stabilizer may be equipped with any of a variety of well understood stabilization means [4] which formats may include straight, spiral or ring blades. Stabilization means may be selected and deployed in preferential fulfillment of geographic regionally dictated operating parameters.

The mandrel element comprises an upper [2], and lower element [3], which are appropriately equipped with rotary threaded connections. The upper mandrel is equipped with a box connection [5], and the lower mandrel is preferentially also provided with a box connection [6], it being the intention to place the device at the near-bit location within the drillstring. Should the device be positioned at an alternate location within the drillstring an alternate pin connection may equally be provided for the lower member [3].

Torque transfer within the bi-partite mandrel configuration allows for torque transfer between mandrel elements by means of a compliant metal-to-metal torque transfer mechanism [7] having ball-joint functionality or any similar structure which allows for relative articulation and compliant structural rigidity between the upper and lower mandrel sub-assemblies [2],[3]. The lower mandrel assembly [3] is held in torsional rigidity relative to the stabilizer sleeve element [1] allowing for relative motion only between upper mandrel [2] and the stabilizer sleeve element [1].

Significant benefits of the compliant vibration damping configuration of the invention are on-centered drill bit alignment, reduction of micro-tortuosity of the borehole, consistent, rather than irregular instantaneous force being applied to the bit cutting structure resulting in reduction to wear of the cutting elements. When the instant invention is utilized with rock-bits, the bearings contained therein are less likely to be damaged by fluctuations in bearing loading. Additionally, the instant device is more likely to result in the drilling of a gauge hole, and less likely to result in "out of round" or "lobed" hole profiles.

The advantageous compliance resulting from the installation of the instant device within the bottom-hole-assembly decouples the torsionally stiff drill collar elements from the bit while still allowing for effective weight transfer from the BHA to the bit cutting structure.

The mandrel [2] [3] articulation is facilitated by upper contact ring [11] and lower contact ring [8] sub assemblies which emulate ball joint functionality. The off bottom contact ring [11] is deployed in conjunction with a locking ring sub-assembly [12], preventing disengagement of the mandrel elements when the assembly is being tripped in or out of the hole. Significant primary axial, rotational and lateral damping capability is added through the inclusion of an upper anti-vibration ring assembly [19]. Drilling fluid passes through a flexible flow tube [13] which has a proximal end [14] which is suspended or locked into a counterbore [15] located in the internal diameter of the proximal mandrel sub-assembly box connection [5]. The flow tube [13] has a distal end [16] which traverses a lower anti-vibration ring [17], and is co-located within that same mechanism wherein it is axially secured by means of a lock ring [18]. The flow tube [13] bridges the flexible area between upper [2] and lower mandrel [3] elements and contributes significantly to the structural rigidity of the device. Additionally the flow-tube [13] provides means for preventing drilling fluid from contaminating the hydraulic reservoir elements of the instant invention.

The seal carrier [38] and lower anti-vibration ring [17], being in the vicinity of the highest amplitude bit vibration, may also preferentially incorporate, piezo electric fibre harvesting elements [37].

Primary passive damping capability within the device is provided by an upper anti-vibration ring [19] which is axially located between the upper mandrel [2] and sleeve elements [1] and which is radially locked into place through the identical locking ring sub assembly [12] which serves as axial retainer for the off-bottom contact ring [11]. The upper anti-vibration ring [19] is composed of closed cell elastomeric material which is placed under compression and suitably dimensioned for the purposes of damping bit generated radial, axial and torsional and lateral shocks.

The properties of the elastomeric materials are selected to achieve damping across a range of frequencies typically associated with rotary drill bits, which properties are suitable for service in a wide range of drilling environments. The upper anti-vibration damping ring [19] is additionally responsible for the stabilization of the upper mandrel [2] and for the effective transfer of unwanted harmonics to the stabilizer sleeve contact area [4] and thence to the borehole wall. The closed cell elastomeric material is, however, constrained in that it has a natural frequency which, in certain scenarios will provide insufficient or ineffective harmonic damping. Alternate configurations using laminated elastomers with different natural frequency properties or dimensional characteristics may be utilized without departing from the spirit of the invention. Any inherent weakness in the passive damping mechanism is compensated for in a scenario which is detailed below.

Figure 2:
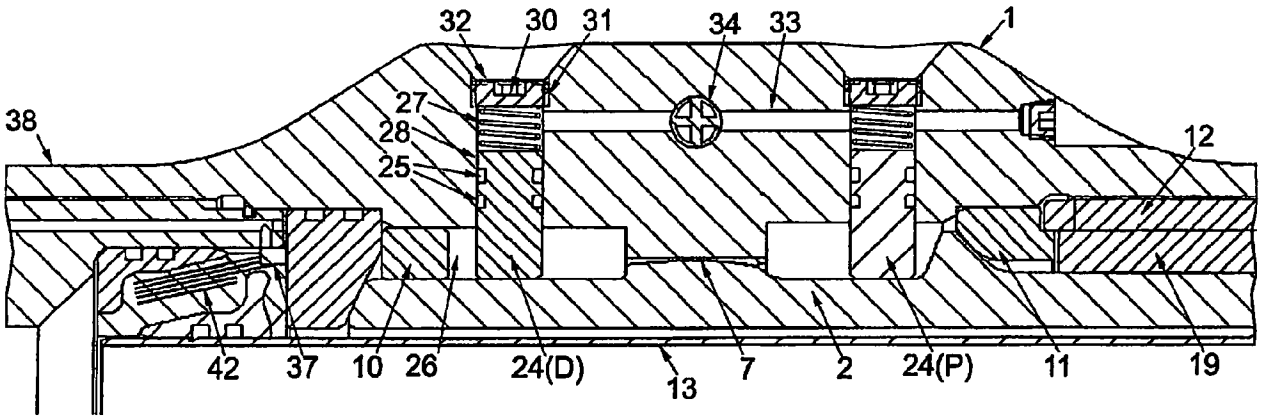
FIG. 2: is an enlarged, partial, longitudinal cross-sectional view of the active damping mechanism housed within the stabilizer contact area.
Figure 3:
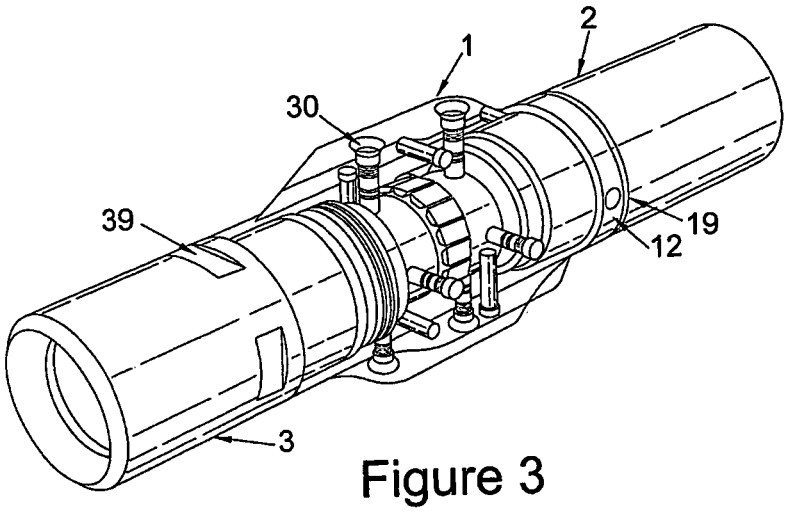
FIG. 3: is a three dimensional rendering representation of FIG. 1.

Referring now to FIGS. 2 and 3: Additional damping capability within the instant device is accomplished through a plurality of damping piston [24] means constrained between upper mandrel sub-assembly [2] and stabilizer body sub assembly [1]. FIGS. 2 and 3 are intended to be illustrative of the concept and represent a quadripartite symmetry which has been selected for ease of description: these Figures are illustrative of the active vibration damping elements and should not be taken as limiting the invention.

Likewise, each set of piston sub-assemblies in the illustrations incorporates paired piston sub-assemblies, representing an ideal configuration. In smaller diameter constructions it may be preferred to construct the invention with a single piston per blade and effect secondary damping by means of inter-blade fluid transfer—as opposed to intra-blade fluid transfer. Each of these methodologies is considered to be within the scope of the instant device.

In one, exemplary configuration, each borehole contact blade or contact point of the stabilizer with the formation [4] sub-assembly is equipped with, at a minimum, two damping piston [24] sub assemblies. Wherever functional distinction is required in the specification, for ease of reference these will be referred to as [24-D] "distal" and [24-P], "proximal."

The pistons [24] are located radially within cylindrical means [28], preferentially integrated into the blade housing [4], [28] and oriented perpendicularly with respect to the principal axis of the borehole, although other orientations made be made without departing from the spirit of the instant device. Each piston [24] is equipped with appropriate sealing means [25] which seals the piston within the blade housing [28]. Thus equipped with seals, the piston [24] sub-divides into inboard chamber [26] and outboard chamber [27] elements. The piston is preferentially biased towards the mandrel [2] by use of compression springs [29] inserted between the piston and the piston cover plug [30] which is retained within the stabilizer housing body by threaded means [31] or by other methods which are well understood within the industry. Preferentially an additional locking mechanism such as a snap-ring [32] is utilized for additional security.

Returning to the chambers [26], [27], which are created by the piston sub assemblies [24], the inboard chamber [26] preferentially contains hydraulic fluid or other lubricating means for the gear assembly [7]. At a radial location outboard of the piston seal sub assemblies [25] the outboard chamber [27] contains magneto-rheological fluid "MR Fluids".

Figure 4:
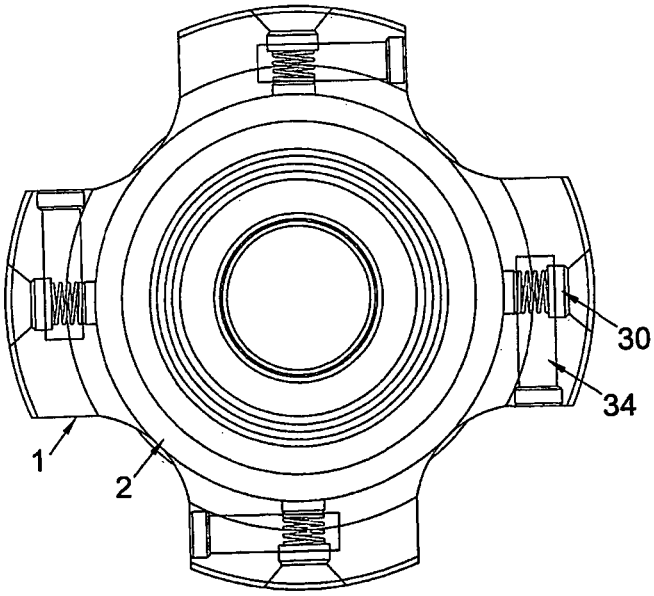
FIG. 4: is a cross sectional view of the invention illustrating a four-bladed configuration of the instant device.

In its simplest configuration, each blade sub-assembly contains within it, a bored passageway [33] which connects the outboard chambers [27] created by piston sub-assemblies [24-P],[24-D], although cross linking between any blade sub-assemblies is also considered within the scope of the instant device. For example, as illustrated in FIG. 4: it may be advantageous to take an input harmonic vibration force from Blade 1, proximal piston sub-assembly [24-P] and apply a restoring damping force to Blade 3 distal piston sub-assembly [24-D].

Control over fluid flow between the outboard chambers [27] may be achieved by means of a low power electro-mechanical valve [34]. It will be evident that the flow of fluid across the valve surfaces is proportional to the relative torsional and lateral motion between upper mandrel [2] and sleeve [1] sub-assemblies. Volumetric fluid flow characteristics may be altered through changes to the relative diameters of cylindrical bores within the stabilizer housing [28] and the through bore [33]. The greater the ratio of diameters, the larger the displacement of fluid within the through bore [33] and the more finely tuned may be the degree of damping control.

Although control over the volume of fluid which is displaced as a result of piston movement and the resulting inter-piston fluid flow will confer secondary damping capability to the distal elements of the BHA, it is envisaged that additional damping capability across a range of frequencies is derived through the alteration of the fluid properties inherent in MR Fluids.

Figure 5:
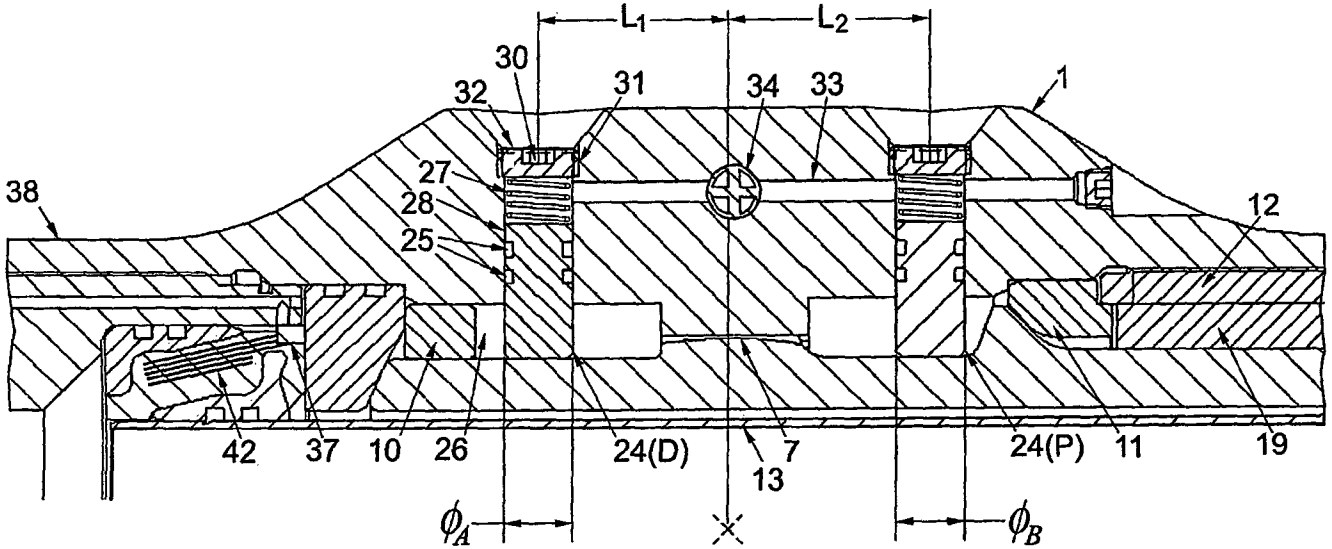
FIG. 5: is an enlarged, partial, longitudinal cross-sectional view highlighting secondary damping piston means and associated fluid transfer mechanism equispaced about the rotational centre of the device.
Figure 6:
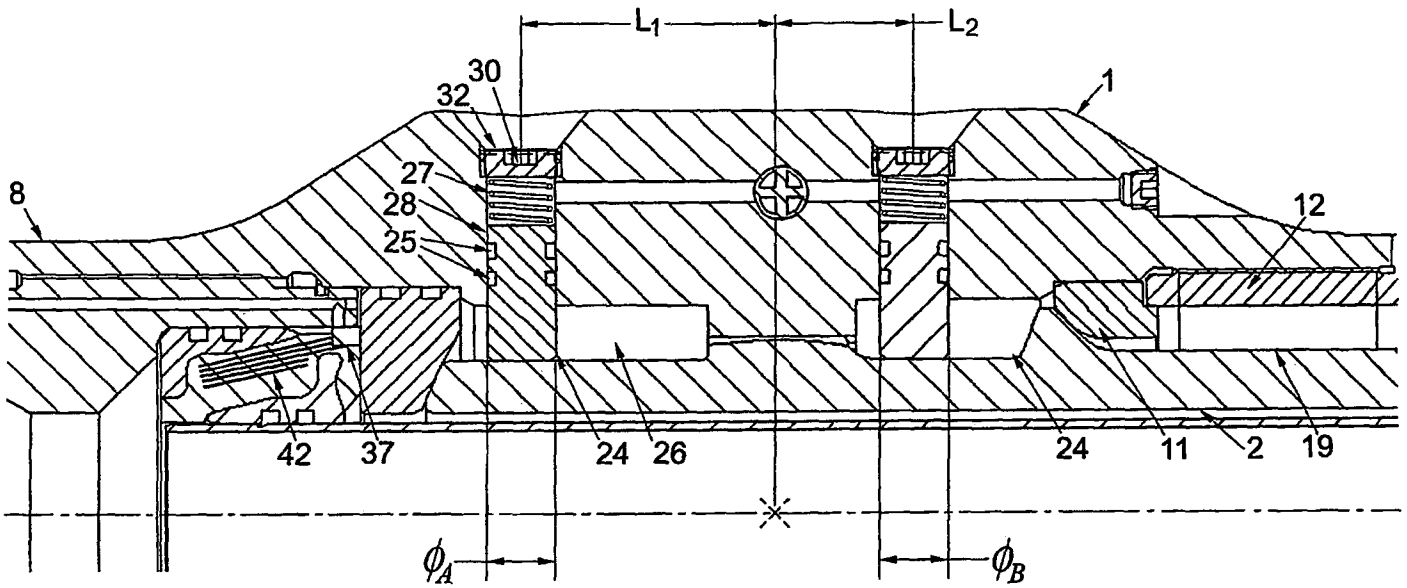
FIG. 6: is an enlarged partial, longitudinal cross-sectional view highlighting secondary damping piston means and associated fluid transfer mechanism differentially spaced about the rotational centre of the device so as to achieve a mechanical advantage.

Referring now to FIGS. 5 and 6, it will further be apparent that the damping capability of the piston means [24-P], [24-D] is such that mechanical advantage may be claimed by adjusting the axial position of the pistons relative to the torque transfer bevel gear [7] between upper mandrel [2] and stabilizer sub assembly [1].

The motion of the pistons [24] may be described as perpendicular-radial with respect to the principal axis of the mechanism although this should not be taken as a constraint on the piston configuration. Thus, irrespective of the relative position of the pistons [24] and the mechanical benefit conferred, thereby, the instant device claims as an inventive step, the transfer of an equal volume of fluid between proximal and distal elements of the bored passageway [33].

FIGS. 5 and 6 also introduce the downhole harvesting of electrical power through the use of piezo-electric technology.

Thus, for example, the optimal position for the location of piezo electric generation is in the region of the lower anti vibration ring and seal carrier sub assembly [17] although any other alternative locations for its installation may be considered within the scope of the instant invention. The selected location is beneficial as it is subject to rotational compression, lateral, torsional and axial vibration. The instant device therefore proposes the generation of electrical power using materials with piezo-electric properties which are integrated into the lower sub-assembly. Piezo-electric fibrous materials are embedded in a matrix and configured as transducers which are responsive to motion, vibration and compression and which recover [waste] mechanical energy from the lower sub-assembly, converting it to electrical power.

Figure 9:
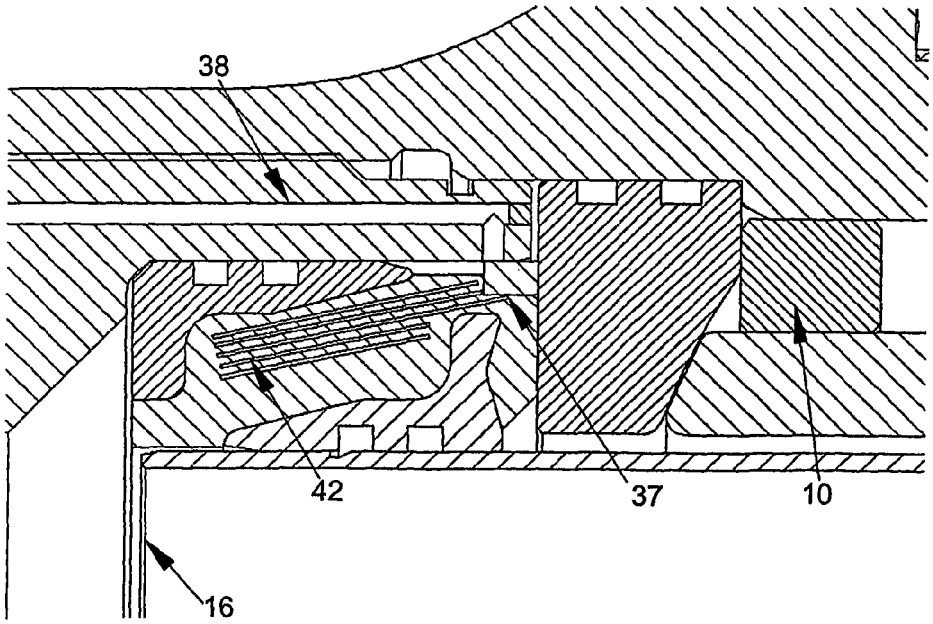
FIG. 9: is an enlarged partial longitudinal cross-sectional view of the seal-carrier sub-assembly, piezo-electric fibre sections and wiring conduits.
Figure 10:
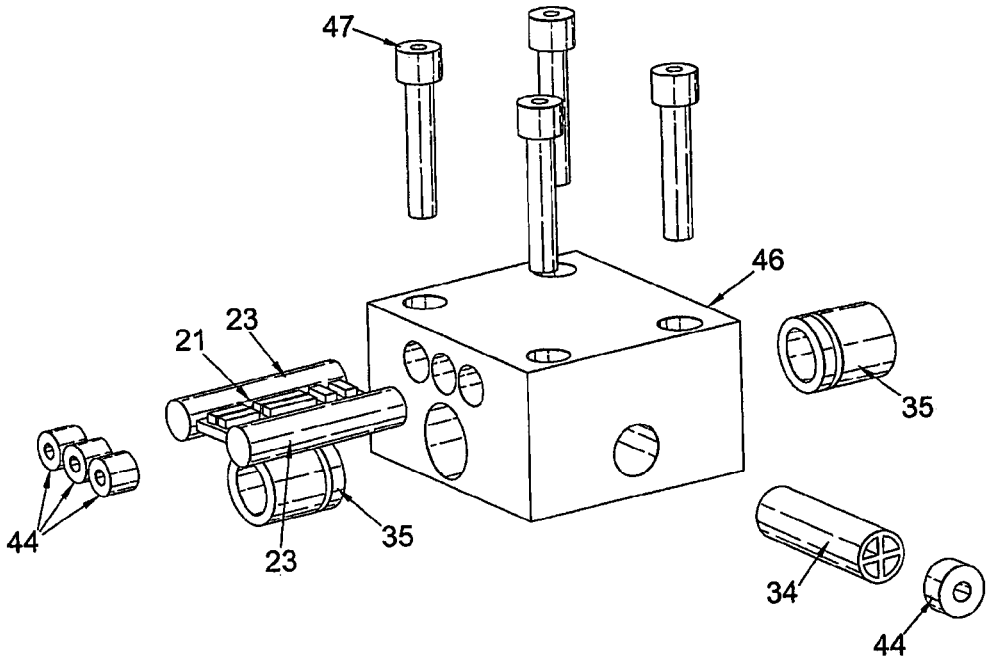
FIG. 10: is an exploded rendered, three-dimensional view of the removable electro-magnetic control and valve housing.

The inherent system symmetry within the instant invention is such that the electrical energy output is in proportion to input vibration. Preferentially, the PE material [42] may be configured in radial nodes within the seal carrier and lower anti-vibration ring [17]. In this configuration non-continuous off-axis vibration can be quantified as a function of generated power. FIG. 9 provides an enlargement of the preferred embodiment of the PE Harvesting sub assembly. The electrical energy is harvested as a by-product of the bit generated vibration which is experienced within the stabilizer body [1] and lower sub assembly, [3] and seal carrier [17] in particular. This sub-assembly, being directly coupled to the bit is subject to maximal axial, lateral and torsional bit vibration, thus realizing peak energy generation capability. A collector ring [37] and associated wiring conduits [38] serve to transfer the harvested power throughout the device.

A further benefit of utilizing piezo-electric fibres [37] within the instant device is that, in addition to its electrical generating capability, it can be used as a relatively accurate indicator of downhole vibration, obviating the requirement for sophisticated sensor arrays. Thus, as PE electrical generating capability is proportional to vibration, if the instrumentation contained within the downhole device is equipped to monitor PE generation levels in conjunction with a clock-timing board, it is able to relate the generated PE electrical charge to vibrational levels.

Contingent on the internal sample rate, the use of PE fibres [37] as sensor may confer the ability to distinguish between vibrational sources, which functionality may be utilized to determine when and where to apply intermittent or sporadic damping capabilities to the magneto-rheological, [36] active vibration damping element of the device.

Additional and alternative locations for incorporating the PE materials [37] may include the upper-anti-vibration ring [19] where the output, measured relative to the output of PE materials incorporated into distal elements of the device may be utilized as a measurement of the damping efficiency of the instant invention. Thus, relative, successive qualitative measurements may serve to indicate internal efficiency of damping mechanism of the instant device and iterative improvements to the active damping mechanism made thereby.

In summary, the PE material [37] capability may be used as an initial condition sensor, when measured against time, and it may be used as a relative measurement of harmonic damping improvement.

Alternatively it may be used as one or more power means for the control of the internal hydraulic circuitry, either for both or each of the MR fluid means or the valve actuation means.

Figure 7:
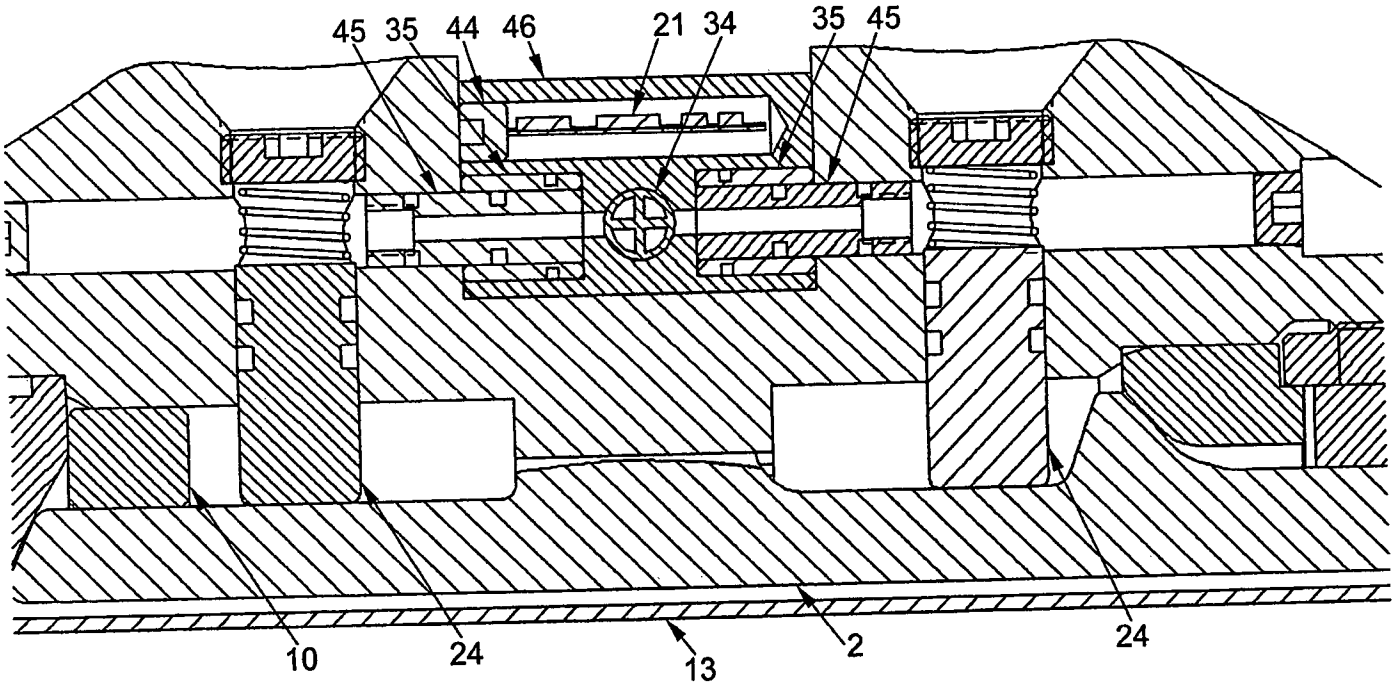
FIG. 7: is an enlarged, partial, longitudinal cross-sectional view highlighting the electro-magnetic coil means radially configured about a single fluid passageway.
Figure 8:
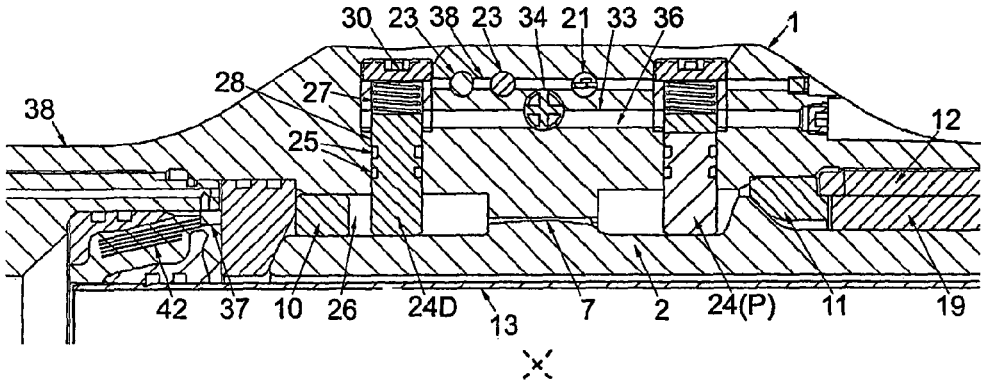
FIG. 8: is an enlarged partial longitudinal cross-sectional view highlighting alternate electro-magnetic coil means radially configured about damping piston means.

Referring now to FIGS. 7 and 8: In furtherance of the aim of variable control over secondary damping means therefore, a preferred embodiment of the instant device is preferentially equipped with electro-magnetic coils [35]. From the perspective of energy efficiency and power conservation [36] it is preferable to configure the coils to be arranged circumferentially about the bored passageway [33]. However, from the perspective of ease of construction, in an alternate embodiment, the coils [35] may be configured circumferentially about the piston means [24] giving rise to differential damping capability and the possibility of damping across multiple frequencies within a single blade sub-assembly. From the perspective of ease of assembly, FIG. 9 illustrates one method of constructing the damping control means whereby the electro-magnetic control and valve housing [46] are bolted [47] into the blade sub-assemblies [4], although any means of retention may equally be utilized.

The configuration of FIGS. 7 through to 9 incorporates auxiliary power in the form of lithium cells [23], which illustrated number is not intended to be a constraint upon the invention. An electronic control mechanism in the form of a PCB mechanism [21] and associated sensors [22] are contained in a pressure vessel within the housing [46] and sealed therein by sealing caps [44] which are equipped with sealing means [not shown] which are well understood by those practiced in the art. Valve means [34] preferentially of electromechanical construction is also sealed into the housing in such a manner as to intersect the bored passageway [33] between proximal outboard chamber [27P] and distal outboard chamber [27D] which chambers are preferentially filled with hydraulic fluids which have magneto-rheological properties. [36].

Electro magnetic coil assemblies are inserted into the housing, providing fluid connection means between proximal outboard chamber and distal outboard chamber and by means of hollow conduits sealing the fluid mechanism within the housing and the stabilizer sub-assembly, with the objective of affecting changes to the viscous properties of the magneto-rheological fluid contained therein.

Recent commercial developments in simplified MR Valve control mechanisms per Ivers, U.S. Pat. No. 6,158,470 may be employed in furtherance of this arrangement.

The instrumentation assembly [21] which is incorporated into the device in order to acquire sensor data and information from both surface and downhole locations, acts as power distributor, logic gate, comparator of sensor outputs and facilitates actuation timing of the active components of the damping piston sub-assemblies. The instrumentation is equipped with a PCB [21] and may be equipped with sensor inputs [22]. Downhole memory is a further function of the instrumentation.

As the instrumentation [21] package is likely to require stable and continuous power supply, parasitic current drain is preferentially to be provided for by high temperature batteries [23] which are frequently deployed and well understood in the industry.

Sensors [22] which may be deployed may include accelerometers, magnetometers, inertial devices, strain gauges or any other sensors which are capable of measuring shock, vibration, acceleration, rotation or other relevant measurements without departing from the spirit of the invention. Sensors of this type are well understood in the industry. Low mass, low power devices may preferentially be deployed, such as MEMS accelerometers.

For the comparative purposes of relative internal measurement within the instant device, a primary, distal, group of sensors [22-D] may preferentially be located within the collective lower mandrel [3] and sleeve sub assemblies [1] with a secondary, proximal [22-P] group of sensors being located within the upper mandrel sub-assembly [2].

Without departing from the spirit of the instant invention, the distal and proximal sensors may be of identical configuration and construction, or alternate means of construction. Additionally, they may be radially indexed for the purposes of obtaining relationally comparative harmonic measurements, or, alternatively, for ease of construction, they may be physically radially offset with temporal or geometrical sensor offsets being applied as required. The number, type, and placement of sensors should not be taken as a limiting factor in the construction of the instant device.

The instant device provides for improvements over prior art insofar as it proposes constructive utilization of the characteristics of the drilling process itself and thus a preferred configuration of the device provides for in situ generation and use of harvested electrical power by means of piezo electric fibre [42].

Typical stable electrical power means incorporated into prior art includes either lithium cells [23] or turbine alternator devices [not illustrated]. The turbine method of electrical power generation is constrained to the provision of power during periods when drilling fluid is being pumped through the drilling assembly. Typically, even when turbines are deployed, battery elements [23] are utilized which can provide continuous current for parasitic devices such as instrumentation [21], clock-timing boards and sensors [22]. Batteries require pressure vessels—in this case the EMC and valve housing—to protect them from the ambient pressure and represent considerable packaging constraints on the design of downhole devices.

Restated, the magnitude of electrical energy which is generated by the piezo-electric materials [42] is thus perceived as having proportionality to the magnitude of bit vibration. It will be appreciated by those skilled in the art that this electrical energy is intermittent in nature and is unlikely to be generated and consumed in the same instant. Therefore, although the PE [37] generated energy may be measured instantaneously as sensor means, it is preferentially stored for later use. Storage for the electrical power is provided in the form of high temperature capacitors which are well known to those versed in the art of downhole electronics construction and are hereby schematically included as being incorporated within the PCB means [21]

A Functional Description

A description will now be made of the idealized functionality of an embodiment of the invention. The description is not intended to provide constraints, but is intended to provide exemplary description of the key elements of the design.

At surface the device is coupled to the bit and lower elements of the BHA; preferentially it is installed in the position of near-bit stabilizer. Functionally, the device is run in the hole and drilling commences using drilling parameters optimized for the particular bit type and formation properties. As bit generated harmonic vibration commences, the passive elastomeric component of the upper anti vibration damping sub assembly prevents the transfer of some of the vibration from the lower mandrel and stabilizer sub assembly to the upper mandrel assembly.

The passive damping mechanism is augmented by the active anti-vibration sub-assembly which comprises a plurality—although probably no less than three in number—of essentially radially configured hydraulic damping piston assemblies. Each damping piston sub-assembly constitutes a plurality of damping piston sub-assemblies which are interconnected by means of passageways or tubular means which are preferably installed within the stabilizer blade sub-assemblies.

At the distal end of the instant device, on making contact with the rock formation, the bit typically generates low frequency vibration which is transferred to PE elements contained preferentially within the seal carriage sub-assembly. The PE elements are subject to stresses resulting from vibration inherent in the near-bit drilling environment and generate electricity which passes through a voltage conditioning circuit and is then stored in capacitors located within the electronics sub assembly. The electrical output of the PE material may be monitored as pseudo-sensor means, indicative of the vibration condition present in the environs of the seal carrier sub assembly. Timing circuitry and logic systems build into the PCB sub-assembly may be made in order to further benefit from the inherent system symmetry where electricity generated is proportional to input harmonic amplitude and frequency.

The capacitors used for storing the PE generated electrical power may be segregated such that they are related to specific radial constructional nodes of PE material and indexed to provide preferential circumferential damping, or charged sequentially or cumulatively for general damping across the entire active vibration damping area.

It will be apparent to those skilled in the art that the intrinsic functional symmetry of the device is such that when peak vibration is at its highest then the electricity which is generated will also be at a maximum and can be applied to the active damping process. Correspondingly, when vibration is at a minimum then active damping requirements are also at a minimum.

In summary, piezo electric generation is always proportional to distal vibration amplitude and frequency.

Thus, a preferred configuration of the instant device relies on symmetrical and proportional application of electrical power derived from vibration to generate an electro-magnetic field which may preferentially be applied to the magneto rheological fluids whose properties have been broadly described earlier in this application. The PE utility may be confined to actuation means, i.e. valve control, where primary electrical power used to alter the MR Fluid properties is provided by lithium cells encapsulated within the instant device and the vibration derived electrical power is utilized to control the valve mechanisms. Alternatively the PE output power may be utilized to alter the MR fluid properties and lithium cell derived electrical power to provide motive force for the low power valve mechanisms. In yet another alternative configuration, the vibration generated electrical power may be used to increment battery power, acting as both input and output, thus quantifying vibration and delivering damping capability.

In a preferred configuration of the instant device the damping piston assemblies are configured with narrow by-pass apertures around which coils are configured to apply an electro-magnetic field to magneto-rheological fluids. The fluid viscosity is altered by applying varying amounts of current and by altering the phase and duration of the current timing in order to create an adaptive and adjustable level of shock damping. The smaller the amount of MR Fluid which requires energizing, the more efficient the instant device will be: thus smaller diameter fluid channels which are circumscribed by EM coils will require less power in order to effect changes to the apparent fluid properties of the MR fluid. This translates into greater mechanical efficiency.

The instant invention may be configured to be sophisticated or relatively simple in format. The overall timing of damping piston strokes and valve actuations is generically under the control of the downhole instrumentation. Utilizing the downlink command protocol increases the information at the disposal of the downhole instrumentation, but, preferably does not override the logic control which the on-board instrumentation exercises.

Damping piston strokes may be preferentially envisaged as being proportional, rather than binary in nature, although in the case of simple harmonic vibration a pure binary damping mechanism may prove adequate. Thus the degree of damping can be controlled with precision by the downhole electronics.

This does not remove the possibility of applying equal damping to all piston assemblies simultaneously, but leaves open the capability of differential and proportional damping stabilization of the assembly through the application of damping to one or more pistons sequentially, discontinuously or continuously, depending on the environment and damping requirement.

In an embodiment of the instant device which was equipped with an limitless energy budget, it may be envisaged that harmonic vibration may be continuously damped with each revolution of the bit, however it is within the scope of the instant device for the active vibration damping mechanism to operate intermittently and disruptively in order to prevent cumulative and incrementing harmonic vibration effects.

It is also within the scope of the instrumentation of the instant invention to phase shift the valve actuation timing in order to minimize transference of bit vibration from the lower sub-assembly to the proximal bottom hole assembly.

At its most simple, a configuration which instantaneously delivers proportional hydraulic damping via vibration generated electrical power, may be used irrespective of whether bit generated vibration is high or low as the generation of electricity and subsequent alteration of the magneto rheological fluid properties is proportional to input system vibration. Thus, when vibration is high, PE generation capability and active damping capability is proportionately high: when vibration is low, PE generation is also low, but there is little or no requirement for active damping.

Alternatively, the trigger for releasing the energy may be simply configured such that a device equipped with capacitors or capacitance banks discharges its energy once the capacitors are fully charged. In this configuration, when the capacitors discharge, a damping pulse is transmitted to one or several of the damping piston assemblies. This would represent the least sophisticated method of delivering active vibration damping, but one which could be honed through iterative procedures. It will be noted that this method requires very little in the way of sensors in able to function.

In a preferred simple embodiment, measurements of PE generation, whether quantitative or qualitative in nature, are used as a substitute for sensor measurements. The effectiveness of such a system is dependent upon the ability to index the measurements to time and tool rotational position. The underlying vibration characteristic—measured as a function of electrical output—establishes the presence or absence of harmonics, the amplitude and dominant frequency of the harmonic. It also allows for simple corrective damping to be applied in phase with and proportionally to the perceived vibration. More sophisticated, out of phase damping may also be applied using this un-instrumented embodiment, but requiring additional downhole processor capability and program algorithms to be developed.

As previously discussed, measurements of shock and acceleration may be taken by sensors located within the lower mandrel. These measurements which are indicative of vibration may be qualitative or quantitative, calibrated or raw as appropriate.

In the first instance the sensor data is gathered for application within the internal logic of the instant device; in a second embodiment, the sensor data is gathered for telemetry back to the surface of the earth using any one of a number of well understood methods. In yet another embodiment, a second, equivalent set of sensors in the upper mandrel sub assembly gather comparative measurements. These measurements are indicative of the efficiency of the active damping device and allow iterative improvements to be made during the drilling process. Sensor measurements are taken and analyzed to determine the input vibrational characteristics and, through the use of adaptive systems the correct time and piston selection and damping energy level is selected with which to achieve optimal damping per available unit of damping energy.

Thus, in an embodiment of the instant device which provides the capability of active vibration damping across a more complex range of harmonic vibration frequencies, sensors take measurements of the vibration characteristics of distal and proximal elements of the device; the piezo-electric devices located within the distal element of the device generate electricity which is then temporarily stored in capacitors prior to being discharged on command from the instrumentation in order to energize the magneto rheological properties of the active vibration device located between the proximal mandrel element and the sleeve assembly, conferring the ability to damp multiple frequencies of harmonic vibration.

This preferred configuration, while intrinsically more complex, has the benefit of allowing for more accurate comparative measurements to be made between the distal and proximal elements of the instant device and thus for damping adjustments to be made which are based on comparative, sequential, sensor measurements. Real-time, iterative adjustments to the actuation timing of the active damping mechanism are made in order to continue reducing the vibrational level which is observed by the proximal mandrel sub-assembly. Ultimately, this leads to an iterative damping process which minimizes the transfer of harmonic vibration to other components of the BHA.

Sensor data may be acquired and retained in the instrumentation memory. Either analogue or digital sensor outputs may be acquired and stored. Sensor data may be stored in the short term for n rotation cycles in order to accurately, quantify, assess and compensate for the vibrational characteristics, such that large amounts of downhole memory are not required, Rapid sampling of sensors may be required either continuously or in bursts in order to quantify tool vibrational environment and damped response. In furtherance of continually adaptive improvements, sensor data also may be subjected to statistical processing or analysis in the distal environment.

The sensor data may be semi-permanently recorded and memory dumped at surface as a record of the environment at the distal and proximal ends of the device. In this way the data may be used for post-run performance indicators, advisory or illustrative purposes or, alternatively, to fine tune the operating characteristics between successive runs.

Alternatively, key indicator data may be retained in memory, such data pertaining to extremes of high level and low level amplitudes and frequencies of drilling vibrational data.

In regions where greater stick-slip and higher rotational velocities are anticipated, such as high inclination intersections between formation bedding planes of differing hardness, the ability to apply phase shifting, intermittent or sequential piston activation to the active vibration damping mechanism may add significant harmonic frequency damping capability, to the device, without compromising the power budget.

Thus, in a preferred embodiment of the device preferably for usage in high vibration environments it is envisaged that the electrical output to the active vibration damping located at the proximal end of the device may be pulsed in such a way as to disrupt the measured harmonic vibration and achieve optimal damping. It is envisaged that, in conjunction with tool reference indexing that this capability may lead to improved directional control, for example, in zones where "skipping" bedding planes takes place. Typically this might occur in environments where relatively hard and soft bedding planes are in juxtaposition. However, if the internal electrical power capability of the device was augmented—such as by the installation of a turbine sub-assembly—the ability to utilize the torque transfer mechanism between sleeve sub assembly and upper mandrel may result in three-dimensional borehole trajectory control capability.

The invention claimed is:

1. A downhole assembly for insertion into a borehole comprising a stabilizer sleeve element radially collocated about a bi-partite mandrel having an articulating and compliant metal-to-metal point of torque transfer, said stabilizer sleeve having passive and active damping mechanisms associated therewith operating upon said bi-partite mandrel and located about said articulating and compliant metal-to-metal point of torque transfer.

2. The downhole assembly according to claim 1, wherein said active damping mechanism acts in a direction with a component substantially perpendicular to the axis of the borehole.

3. The downhole assembly according to claim 1, wherein said active damping mechanism comprises a hydraulic damping mechanism.

4. The downhole assembly according to claim 3, wherein said hydraulic damping mechanism comprises a plurality of piston sub-assemblies each configured as a pair of pistons acting on said bi-parte mandrel, wherein said paired pistons of each piston sub-assembly are in fluid communication with one another.

5. The downhole assembly according to claim 4, wherein hydraulic fluid is transferred between paired pistons in each piston sub-assembly in a closed hydraulic loop.

6. The downhole assembly according to claim 5, wherein in each piston sub-assembly said two pistons are spaced axially at differing positions along said bi-parte mandrel.

7. The downhole assembly according to claim 4 further comprising electro-mechanical or electro-hydraulic valve means and, wherein said electro-mechanical or electro-hydraulic valve means are configured to control the flow of fluid between said piston pairs within each piston sub-assembly.

8. The downhole assembly according to claim 1, wherein said active damping mechanism comprises resilient material.

9. The downhole assembly according to claim 1 wherein said damping mechanisms comprise electro-mechanical or electro-hydraulic valve means.

10. The downhole assembly according to claim 1, wherein the active damping mechanism comprises rheological materials.

11. The downhole assembly according to claim 10, further comprising magnets configurable to influence the properties of said rheological materials.

12. The downhole assembly according to claim 1, wherein said active and passive damping means are configured to provide lateral, axial and torsional damping.

13. The downhole assembly according to claim 1, further comprising a stabilizer member configured to center said assembly in a borehole, said stabilizer comprising a plurality of blades and configured to provide energy dissipation to said borehole wall.

14. The downhole assembly according to claim 13, wherein said active damping mechanism is at least partially housed in at least one of said blades.

15. The downhole assembly according to claim 1, wherein the relative motion has a component lateral to the axis of the bore hole.

16. The downhole assembly according claim 1, further comprising piezo electric members configured to convert vibrations in said assembly into an electrical output.

17. The downhole assembly according to claim 16, wherein said electrical output provides power for said active damping mechanism proportional to any one of input vibration amplitude or frequency.

18. The downhole assembly according to claim 16, adapted to use the output from the piezo electric members for measurement, as a means of quantifying forces to be applied or as an actuation motive means within the device.

19. The downhole assembly according claim 1, further comprising a torque transfer mechanism and a resilient fluid passageway adapted to provide intra-structural support thereby serving to isolate said torque transfer mechanism and said active vibration damping mechanism from drilling fluids.

20. The downhole assembly according claim 1, further comprising receiving means configured to receive information from sensors located within said downhole assembly.

21. The downhole assembly according claim 20, wherein said receiving means is configured to receive information from a plurality of locations within the environ of the borehole or on said downhole assembly.

22. A method of controlling vibration in a downhole assembly said method comprising; providing a stabilizer sleeve element radially collocated about a bi-partite mandrel having an articulating and compliant metal-to-metal point of torque transfer in a borehole; and both passively and actively damping said bi-partite mandrel about said articulating and compliant metal-to-metal point of torque transfer.

23. The method according to claim 22, wherein the damping capability is modifiable and variable in both frequency and amplitude, responsive to harmonic vibration encountered in the environs of a drill bit in communication with said articulated bi-partite mandrel.

24. The method according to claim 22, wherein said damping is hydraulic and hydraulic actuation is proportional, continuous, discontinuous, intermittent or sporadic in response to particular harmonic vibration encountered by said articulated bi-partite mandrel located in the environs of a drill bit.

* * * * *